US005431469A

United States Patent [19]

Ohno et al.

[11] Patent Number: 5,431,469

[45] Date of Patent: Jul. 11, 1995

[54] VACUUM LIFT DEVICE

[75] Inventors: Masayuki Ohno, Tokyo; Takayoshi Nakamura, Atsugi; Hiroshi Yamada, Kofu, all of Japan; Kurt Schmalz; Wolfgang Schmalz, both of Dornstetten, Germany

[73] Assignees: Kabushiki Kaisha Kito, Yamanashi, Japan; J. Schmalz GmbH, Glatten, Germany

[21] Appl. No.: 129,280

[22] Filed: Sep. 29, 1993

[30] Foreign Application Priority Data

Oct. 2, 1992 [JP] Japan ..... 4-265099
Aug. 24, 1993 [JP] Japan ..... 5-209484

[51] Int. Cl.[6] ..... B66C 1/02
[52] U.S. Cl. ..... 294/64.1; 414/627
[58] Field of Search ..... 294/64.1-65; 414/626, 627, 737, 752; 901/40

[56] References Cited

U.S. PATENT DOCUMENTS

| | | | |
|---|---|---|---|
| 3,677,598 | 7/1972 | Becker | 294/64.1 |
| 3,743,340 | 7/1973 | Williamann | 294/64.1 |
| 4,266,905 | 5/1981 | Birk et al. | 294/64.1 X |
| 4,412,775 | 11/1983 | Molitor et al. | 414/626 |
| 4,413,853 | 11/1983 | Andersson | 294/64 R |
| 4,557,659 | 12/1985 | Scaglia | 294/64.1 X |
| 4,720,227 | 1/1988 | Eberle | 294/64.1 X |
| 5,039,274 | 8/1991 | Bennison | 414/752 X |
| 5,330,314 | 7/1994 | Bennison | 294/64.1 X |

FOREIGN PATENT DOCUMENTS

| | | |
|---|---|---|
| 0493979 | 7/1992 | European Pat. Off. . |
| 0509115 | 10/1992 | European Pat. Off. . |
| 1474799 | 3/1967 | France . |
| 3618704C1 | 6/1987 | Germany . |
| 62-25344 | 6/1987 | Japan . |

*Primary Examiner*—Dean Kramer
*Attorney, Agent, or Firm*—Pennie & Edmonds

[57] ABSTRACT

A vacuum lift device comprising a lift tube which is able to contract and expand in an upward and downward direction, and a lift tube expansion control valve controlling the opening areas of the atmospheric openings of the lift tube. A hovering control valve controlling the flow area between the second atmospheric opening and the interior of the lift tube is provided. The lift tube expansion control valve is normally positioned at a position such that is completely covers the first atmospheric opening, and the second atmospheric opening is open to the outside space. At this time, the level of vacuum in the lift tube is adjusted by the hovering control valve so that an object to be lifted is maintained at a desired height.

17 Claims, 18 Drawing Sheets

VACUUM LIFT DEVICE

BACKGROUND OF INVENTION

1. Field of the Invention

The present invention relates to a vacuum lift device.

2. Description of the Related Art

A known vacuum lift device comprises a vacuum operated type lift tube which is able to expand and contract in an upward and downward direction, and a lift tube expansion control valve controlling the level of vacuum in the lift tube by controlling the opening area of the atmospheric opening of the lift tube to cause the lift tube to expand and contract in an upward and downward direction (see Japanese Examined Utility Model Publication No. 62-25344). In this vacuum lift device, for example, an object to be lifted is initially sucked and held by the lower end portion of the lift tube, and then the object is lifted by contracting the lift tube by operating the lift tube expansion control valve. Then, the object thus lifted is maintained at a desired height by operating the lift tube expansion control valve. Then, the object is caused to move to another place in a state where the object is maintained at a desired height. Then, the object is lowered and placed there.

As mentioned above, a contraction control for lifting the object, a contraction and expansion stopping control for maintaining the object at a desired height and an expansion control for lowering the object are required for the lift tube. In a known device, these three controls are carried out by using only the lift tube expansion control valve.

In such a vacuum lift device, the lift tube expansion control valve is completely closed when the level of vacuum in the lift tube is to be made maximum, and the lift tube expansion control valve is fully open when the level of vacuum in the lift tube is to be made minimum. In this case, the quicker the level of vacuum can be lowered the larger the opening area of the atmospheric opening, obtained when the lift tube expansion control valve is fully open, is made. Accordingly, the opening area of the atmospheric opening, obtained when the lift tube expansion control valve is fully open, is normally made relatively large. Namely, to quickly expand and contract the lift tube, the control range of the opening area by the lift tube expansion control valve is normally made considerably wide, and therefore, if the lift tube expansion control valve is slightly displaced, the opening area of the atmospheric opening changes considerably.

However, to maintain the object at a desired height, the level of vacuum in the lift tube must be maintained at a constant level corresponding to the weight of the object. Namely, in this case, if the level of vacuum in the vacuum lift becomes slightly higher than this constant level, the lift tube contracts and, if the level of vacuum in the vacuum lift becomes slightly lower than this constant level, the lift tube expands. That is, to maintain the object at a desired height, the precise control of the opening area of the atmospheric opening is required.

However, in a known vacuum lift device, as mentioned above, if the lift tube expansion control valve is slightly displaced, the opening area of the atmospheric opening changes considerably, and thus it is difficult to carry out the precise control of the opening area of the atmospheric opening by the lift tube expansion control valve. Accordingly, a problem arises in that, if the opening area of the atmospheric opening is controlled by the lift tube expansion control valve so as to maintain the object at a desired height as in this known vacuum lift device, it is difficult to properly maintain the object at a desired height.

SUMMARY OF THE INVENTION

An object of the present invention is to provide a vacuum lift device capable of property maintaining an object lifted by the vacuum lift to a desired height.

According to the present invention, there is provided a vacuum lift device comprising: a vacuum source; a vacuum operated type lift tube expandable in a vertical direction and having an interior connected to the vacuum source, the lift tube having an atmosphere opening which interconnects the interior of the lift tube to the outside air; a lift tube control valve for controlling an opening area of the atmospheric opening to control a level of vacuum in the interior of the lift tube and thereby cause the lift tube to expand and contract in a vertical direction; and hovering control means provided separately from the lift tube control valve, for controlling a flow area of an air between the interior of the lift tube and the outside air to maintain an object lifted by the lift tube at a desired height.

The present invention may be more fully understood from the description of preferred embodiments of the invention set forth below, together with the accompanying drawings.

DESCRIPTION OF PREFERRED EMBODIMENTS

Figure 1:
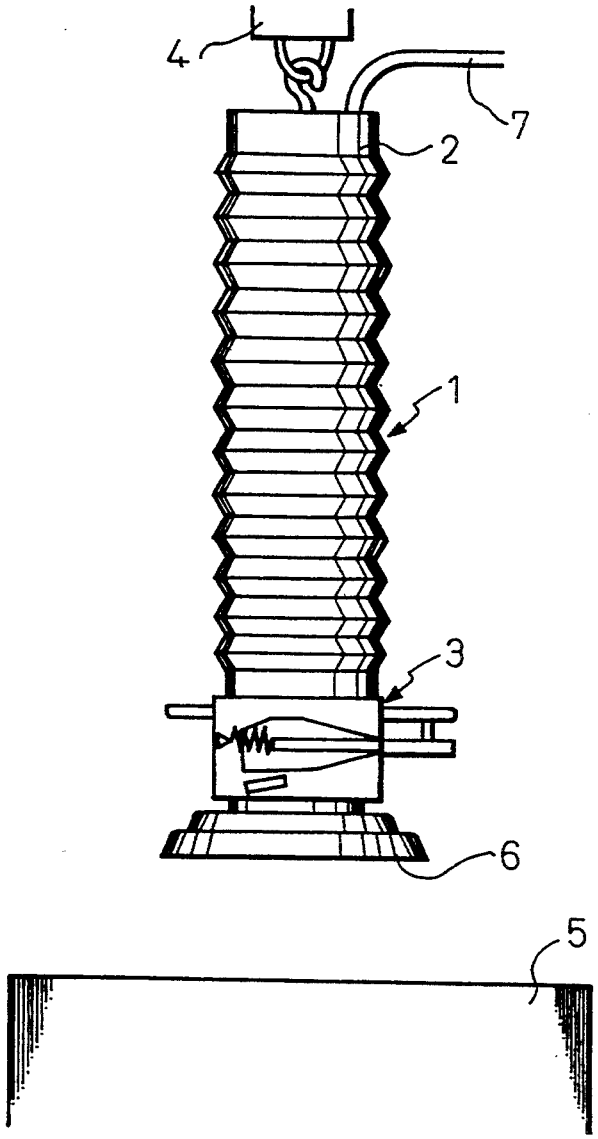
FIG. 1 is a general view of a vacuum lift device.

Referring to FIG. 1, a vacuum lift device comprises a lift tube 1 made of a flexible material and expandable in the axial direction thereof, i.e., in an upward and downward direction, a cylindrical casing 2 attached to the upper end portion of the lift tube 1, and a suction control apparatus 3 attached to the lower end portion of the lift tube 1. The cylindrical casing 2 is hung on a support member 4 fixed to the support beam or supported by the support beam so that it is able to move in the horizontal direction. The suction control apparatus 3 has at its lower end a suction pad 6 for sucking and holding an object 5 to be lifted. The interior of the lift tube 1 is connected to the suction pump (not shown) via a conduit 7, and air in the lift tube 1 is continuously sucked by this suction pump. Accordingly, vacuum is normally produced in the lift tube 1.

Referring to FIGS. 2 through 5, the suction control apparatus 3 comprises four side walls 8*a*, 8*b*, 8*c*, 8*d*, a bottom wall 9, a flange portion 10 extending inward from the upper ends of the side walls 8*a*, 8*b*, 8*c*, 8*d*, and a cylindrical portion 11 fixed onto the flange portion 10. The lower end portion of the lift tube 1 is fixed to the outer circumferential wall of the cylindrical portion 11 in an air tight manner. Accordingly, the interior chamber 13 of the suction control apparatus 3, which is surrounded by the side walls 8*a*, 8*b*, 8*c*, 8*d*, the cylindrical portion 11 and the bottom wall 9, is in communication with the interior of the lift tube 1, and accordingly, vacuum is produced normally in the interior chamber 13.

Figure 2:
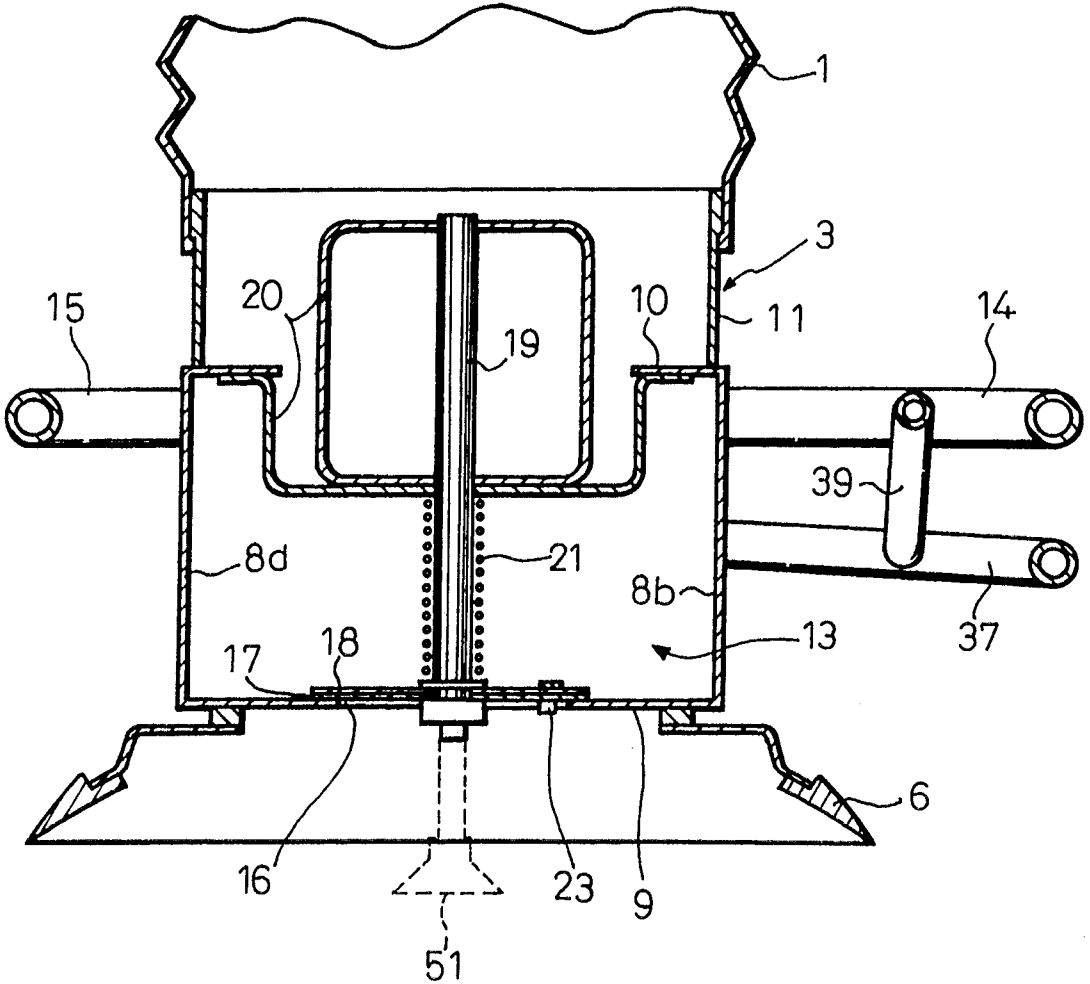
FIG. 2 is a cross-sectional side view of the suction control apparatus.
Figure 3:
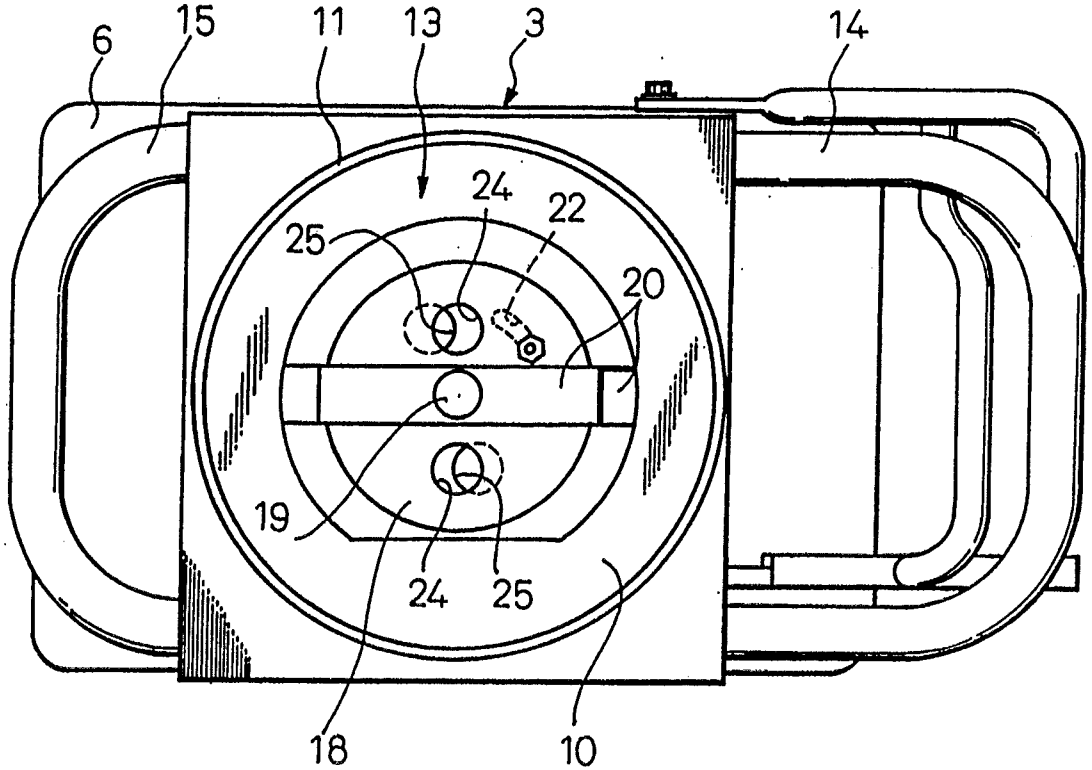
FIG. 3 is a plan view of the suction control apparatus.

Grip portions 14, 15 each having a U shape are fixed to the outer side faces of the side walls 8*b*, 8*d*, respectively. In addition, as illustrated in FIG. 2, an opening 16 having a circular shape is formed on the bottom wall 9 and covered by a pair of disc plates 17, 18 having a diameter which is larger than that of the opening 16. These disc plates 17, 18 are rotatably mounted on the lower end portion of a rod 19 which extends upward in the interior chamber 13. The upper portion of the rod 19 is supported by rod guide members 20 fixed to the flange portion 10 so that the rod 19 is able to move in the axial direction thereof. The rod 19 is biased downward by a compression spring 21 which is inserted around the rod 19, and thus, a pair of the disc plates 17, 18 are seated on the bottom wall 9 due to the spacing force of the compression spring 21. Accordingly, the opening 16 is normally closed by a pair of the disc plates 17, 18.

A pair of the disc plates 17, 18 are mounted on the rod 19 so that they are able to relatively rotate about the rod 19, and these disc plates 17, 18 are caused to relatively rotate by a pin 23 fixed to the disc plate 18 and projecting downward through a slot 22 formed on the disc plate 17. A plurality of through holes 24 and 25, which are aligned with each other when the disc plates 17, 18 are caused to relatively rotate, are formed on the disc plates 17 and 18, respectively, and it is possible to change the area of the overlapping portion of the through holes 24, 25 by relatively rotating the disc plates 17, 18.

Figure 4:
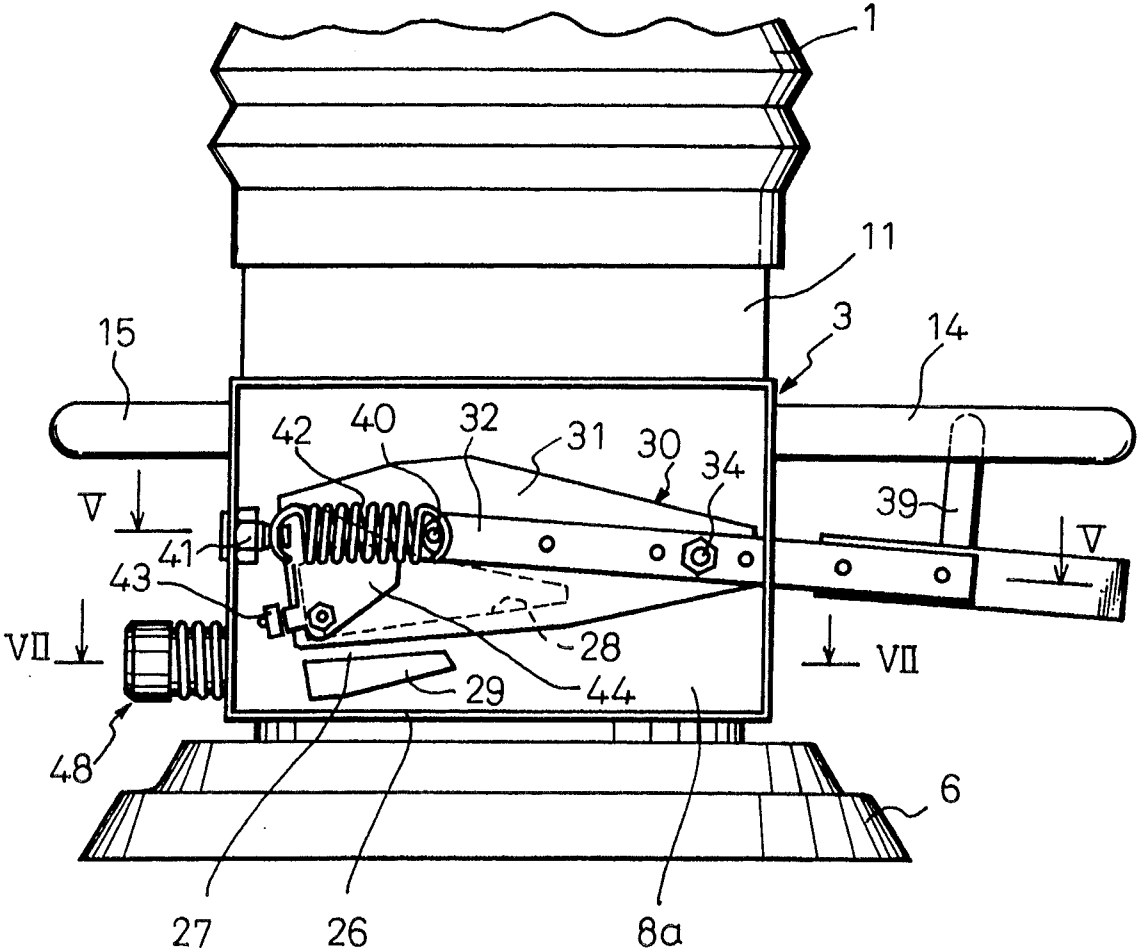
FIG. 4 is a side view of the suction control apparatus.
Figure 5:
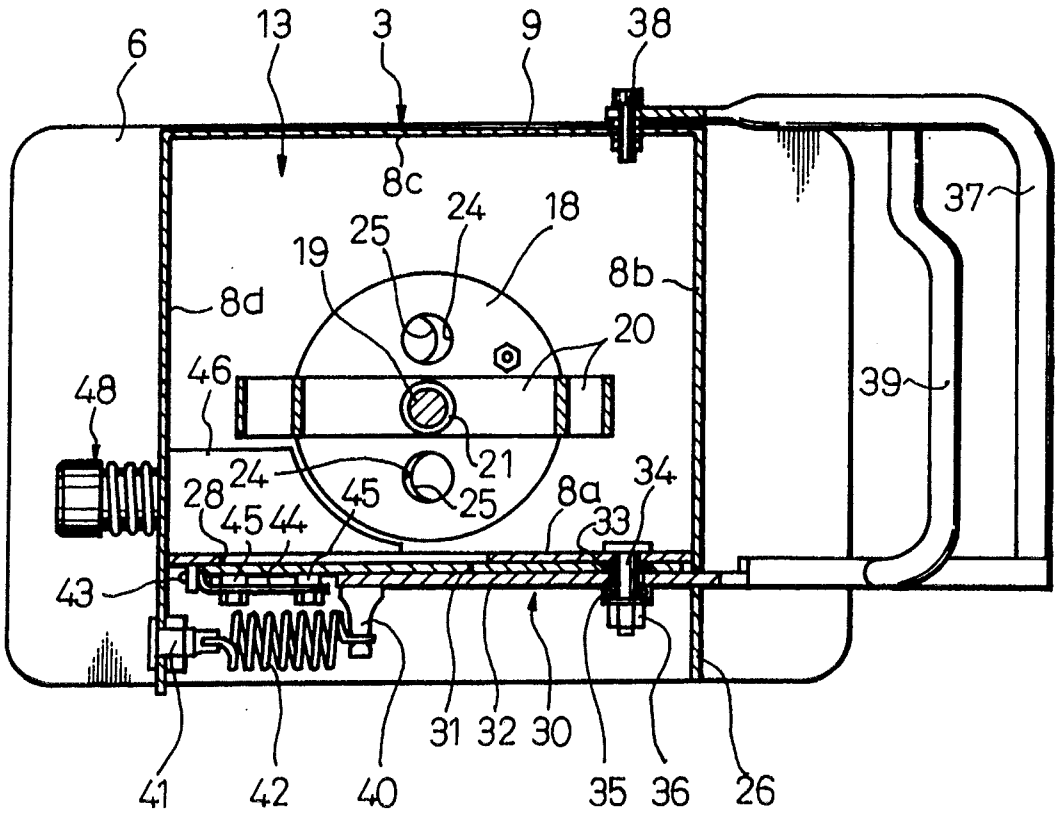
FIG. 5 is a cross-sectional plan view taken along the line V—V in FIG. 4.

As can be seen from FIGS. 4 and 5, a frame 26 having a rectangular shape projects in a transverse direction from the outer peripheral edge of the side wall 8*a*, and thus the outer side face of the side wall 8*a* is such that it is surrounded by the frame 26. A first atmospheric opening 28 having a large area and a second atmospheric opening 29 having a small area, which openings are spaced via a band-like side wall portion 27, are formed on the side wall 8*a*, and a lift tube expansion control valve 30 for controlling the opening areas of these atmospheric openings 28, 29 is arranged in the frame 26. This lift tube expansion control valve 30 comprises a flat valve plate 31 movable along the outer face of the side wall 8*a*, and a lever 32 supporting the valve plate 31. The lever 32 is rotatably mounted on a support shaft 34 via a radial bearing 33. In addition, this lever 32 is supported by a nut 36 via a thrust bearing 35. The lever 32 extends through the frame 26 and projects outward therefrom, and an operation arm 37 having a U shape is fixed to the projecting portion of the lever 32. The end portion of the operation arm 37 is supported on the side wall 8*c* via a pivot pin 38 which is arranged coaxially with the support shaft 34. In addition, the operation arm 37 has another operation arm 39 extending upward therefrom. The lever 32 and the valve plate 31 are rotated about the support shaft 34 by operating one of the operation arms 37 and 39.

A spring retainer 40 projecting outward is fixed to the inner end portion of the lever 32, and another spring retainer 41 is fixed to the frame 26 located on an opposite side of the support shaft 34 with respect to the spring retainer 40. A tension spring 42 is arranged between these spring retainers 40 and 41. Accordingly, the lever 32 is normally maintained at a position such that the spring retainers 40 and 41 and the support shaft 34 are located on a straight line due to the spring force of the tension spring 42, as illustrated in FIG. 4. The position of the spring retainer 41 is determined so that the lower edge of the valve plate 31 is located half way on the height of the band-like side wall portion 27 when the spring retainers 40 and 41 and the support shaft 34 are located on the straight line. In addition, the first atmospheric opening 28 is formed at a position such that it is completely covered by the valve plate 31 when the spring retainers 40 and 41 and the support shaft 34 are located on the straight line. If the valve plate 31 is caused to rotate in a clock wise direction against the spring force of the tension spring 42 by operating the operation arms 37, 39, the first atmospheric opening 28 is caused to be open to the outside space. Conversely, if the valve plate 31 is caused to rotate in a counter-clockwise direction against the spring force of the tension spring 42 by operating the operation arms 37, 39, the second atmospheric opening 29 is also covered by the valve plate 31 in addition to the first atmospheric opening 28. The second atmospheric opening 29 is formed at a position such that it can be completely covered by the valve plate 31 when the valve plate 31 is rotated in a counter-clockwise direction.

Figure 6:
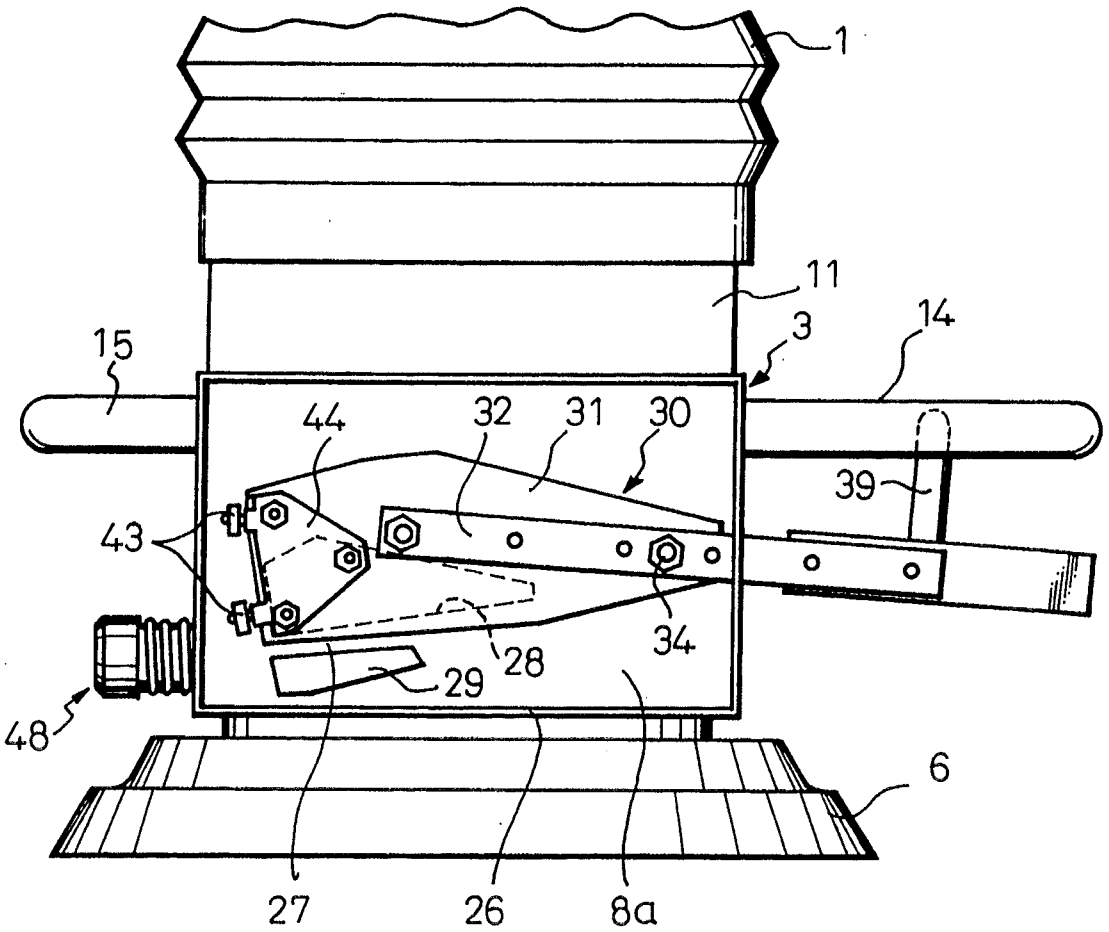
FIG. 6 is a side view of the suction control device with the spring retainer and the tension spring being removed.

FIG. 6 illustrates the case where the spring retainer 41 and the tension spring 42 are removed. Referring to FIGS. 4 through 6, a roller support plate 44 is fixed to the valve plate 31 via spacers 45, and a pair of rollers 43 each rolling on the outer face of the side wall 8*a* are rotatably supported by the roller support plate 44. The valve plate 31 is slightly floated from the outer wall of the side wall 8*a* by the rollers 43. Since the valve plate 31 is slightly floated from the outer face of the side wall 8*a* as mentioned above; the inner tip end of the valve plate 31 is supported on the outer face of the side wall 8*a* via the rollers 43; and the lever 32 is supported by the support shaft 34 via the radial bearing 33 and the thrust bearing 35, it is possible to rotate the lift tube expansion control valve 30 with an extremely small operation power.

Figure 7:
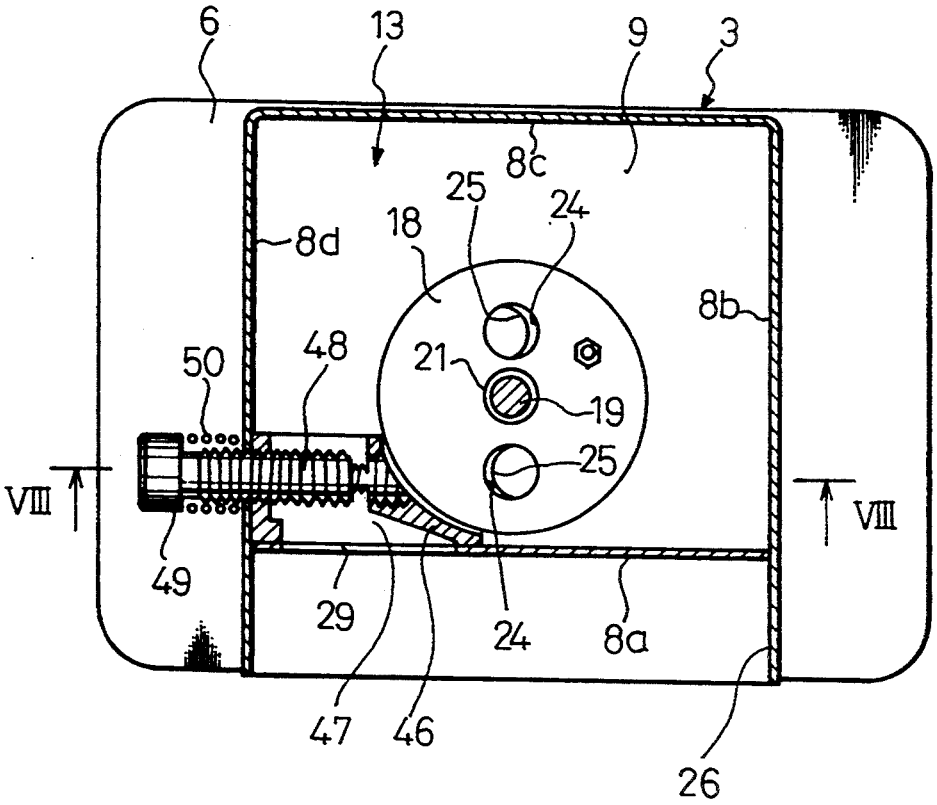
FIG. 7 is a cross-sectional plan view taken along the line VII—VII in FIG. 4.
Figure 8:
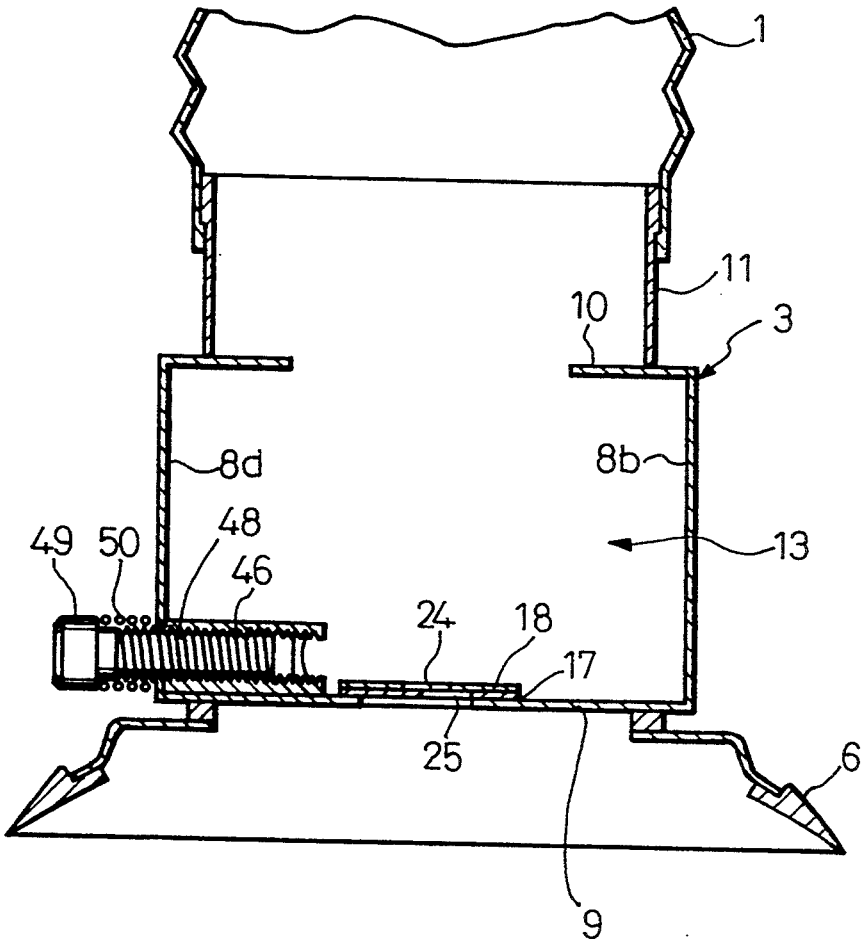
FIG. 8 is a cross-sectional side view taken along the line VIII—VIII in FIG. 7.

Referring to FIGS. 7 and 8, a block 46 is arranged on the inner face of the side wall 8*a* so as to cover the second atmospheric opening 29, and a connecting bore 47 interconnecting the second atmospheric opening 29 to the interior chamber 13 is formed in the block 46. A hovering control valve 48 which is able to project into and retract from the connecting bore 47 is arranged in the connecting bore 47. In the embodiment illustrated in FIGS. 7 and 8, the hovering control valve 48 has a bolt-like shape. Namely, inner threads engaging with the outer threads of the hovering control valve 48 are formed in the block 46 and, if the hovering control valve 48 is rotated, the hovering control valve 48 is caused to move in the axial direction thereof. The connecting bore 47 has a height which is almost the same as the reduced diameter portion of the inner threads formed in the block 46, and accordingly, if the tip portion of the hovering control valve 48 projects into the connecting bore 47, the flow area of the connecting bore 47 is reduced by an amount corresponding to the projecting part of the hovering control valve 48. Therefore, it is possible to control the flow area of the connecting bore 47 by rotating the hovering control valve 48. The hovering control valve 48 projects outward from the side wall 8*d*, and an operation portion 49 is formed on the projecting tip portion of the hovering control valve 48. A compression spring 50 is inserted between the operation portion 49 and the side wall 8*d* to prevent the position of the hovering control valve 48 from deviating from a regular position.

When the lift tube 1 is to be expanded to suck an object, the lift tube expansion control valve 30 is rotated in a clockwise direction to cause the first atmospheric opening 28 to be open to the outside space. If the first atmospheric opening 28 is open to the outside space, since a large amount of air flows into the interior chamber 13 from the first atmospheric opening 28, the level of vacuum in the lift tube 1 rapidly becomes low, and thus the lift tube 1 is expanded due to the weight of the suction control apparatus 3. After this, when the suction pad 6 is seated on the object 5, the lift tube expansion control valve 30 is made to be in a free state, i.e., the lift tube expansion control valve 30 is returned to the position illustrated in FIG. 4, and thus the first atmospheric opening 28 is covered by the lift tube expansion control valve 30. As a result, the level of vacuum in the lift tube 1 becomes high again.

When the suction pad 6 is seated on the object 5, air in the suction pad 6 is sucked into the interior chamber 13 via the through holes 24, 25 formed on the disc plates 17, 18. As a result, since vacuum is produced in the suction pad 6, the object 5 is sucked and held by the suction pad 6. In this case, where the object 5 is made of material in which air easily penetrates, since air penetrates the object 5 and is fed into the suction pad 6, the level of vacuum in the suction pad 6 does not become sufficiently high, resulting in that the object 5 can not be sucked by the suction pad 6. In this case, an adopter 51 illustrated by the broken line in FIG. 2 is screwed into the lower end of the rod 19. If the adopter 51 is attached to the rod 19, when the suction pad 6 is seated on the object 5, the adopter 51 and the rod 19 are caused to move upward against the spring force of the compression spring 21 by the object 5. As a result, since the disc plates 17, 18 move upward, the interior of the suction pad 6 and the interior chamber 13 are in communication with each other via a large clearance formed between the bottom wall 9 and the periphery of the disc plates 17, 18. Accordingly, even if air flows into the suction pad 6 via the object 5, a great vacuum is produced in the suction pad 6, and thus, the object 5 can be sucked and held by the suction pad 6. Note that, when the suction pad 6 is seated on the object 5, if the lift tube expansion control valve 30 is operated to temporarily cover the second atmospheric opening 29 so that the level of vacuum in the interior chamber 13 temporarily becomes high, the object 5 can be instantaneously sucked and held by the suction pad 6.

Then, if both the first atmospheric opening 28 and the second atmospheric opening 29 are covered by the lift tube expansion control valve 30 by rotating the lift tube expansion control valve 30 in a counter clockwise direction, the level of vacuum in the lift tube 1 rapidly becomes high. As a result, the lift tube 1 contracts, and the object 5 is lifted by the lift tube 1. Where the object 5 which has been lifted is to be lowered, the first atmospheric opening 28 is caused to be open to the outside space by rotating the lift tube expansion control valve 30 in a clockwise direction to lower the level of vacuum in the lift tube 1. When the object 5 is to be taken off from the suction pad 6, the opening area of the first atmospheric opening 28 is further increased to further lower the level of vacuum in the suction pad 6.

Next, a control for maintaining the suction control apparatus 3 at a desired height, i.e., a hovering control will be described. This hovering control comprises controls of two types, i.e., a hovering control for maintaining the suction control apparatus 3 at a desired height in state where the object 5 is lifted, and a hovering control for maintaining the suction control apparatus 3 at a desired height in a no-load state wherein the object 5 is not lifted. First, the former hovering control will be described.

When the hovering control is carried out, the operation arms 37, 39 are made to be in a free state, and thus, at this time, the lift tube expansion control valve 30 is in the position illustrated in FIG. 4. Accordingly, at this time, the outside air is continuously fed into the interior chamber 13 via the second atmospheric opening 29. To maintain the suction control device 3 and the object 5 at a desired position, the upward force acting on the lift tube 1 by vacuum must be balanced with the downward force caused by the weight of the suction control device 3 and the object 5, and therefore, at this time, the level of vacuum to be produced in the lift tube 1 changes in accordance with the weight of the object 5. In addition, at this time, the level of vacuum to be produced in the lift tube 1 also changes in accordance with whether or not air penetrates the object 5. Namely, the level of vacuum to be produced in the lift tube 1 changes in accordance with the object 5.

To maintain the suction control apparatus 3 and the object 5 at a desired height, initially, the lift tube 1 is slightly contracted in a state where the object 5 is sucked and held by the suction pad 6. Then, the operator's hand is released from the operation arms 37, 39 to make the operation arms 37, 39 in a free state. Then, the hovering control valve 48 is adjusted so that the lift tube 1 neither contracts nor expands. The hovering control valve 48 makes it possible to precisely control the opening area of the connecting bore 47, and thus, it is possible to control the opening area of the connecting bore 47 so that the lift tube 1 completely ceases to contract and expand. Once the adjustment of the hovering control valve 48 is completed, if the operator's hand is released from the operation arms 37, 39, the contracting and expanding action of the lift tube 1 is completely stopped as long as the same kind of the object 5 is handled, and thus the suction control apparatus 3 and the object 5 are maintained at a desired height.

As illustrated in FIG. 4, where the lift tube expansion control valve 30 is maintained at a stable position illustrated in FIG. 4 due to the spring force of the tension spring 42, when the operator's hand is released from the operation arms 37, 39, and thereby the lift tube expansion control valve 30 is returned to the stable position, the lift tube expansion control valve 30 is not always returned to the exactly same stable position, but slightly deviates from the regular stable position every time the lift tube expansion control valve 30 is returned to the stable position. However, since the lift tube expansion control valve 30 is arranged so that the lower edge of the lift tube expansion control valve 30 is positioned approximately at the middle of the band-like side wall portion 27 when the lift tube expansion control valve 30 is in the stable position, even if the lift tube expansion control valve 30 slightly deviates from the regular stable position when the lift tube expansion control valve 30 is returned to the stable position, the first atmospheric opening 28 is completed covered by the lift tube expansion control valve 30, and the entirety of the second atmospheric opening 29 is open to the outside space. Accordingly, since the position of the lift tube expansion control valve 30, which is taken when the lift tube expansion control valve 30 is returned to the stable position, does not have any influence on the level of vacuum in the lift tube 1, if the operator's hand is released from the operation arms 37, 39, the suction control apparatus 3 and the object 5 are properly maintained at a desired height.

Conversely, the object 5 is not sucked and held by the suction pad 6, and thus, to maintain only the suction control apparatus 3 at a desired height, the level of vacuum in the lift tube 1 must be lowered as compared with the case where both the suction control apparatus 3 and the object 5 are maintained at a desired height. In this case, the level of vacuum in the lift tube 1 is adjusted by relatively rotating the disc plates 17, 18 to change the area of the overlapping portion of the through holes 24 and 25.

Figure 9:
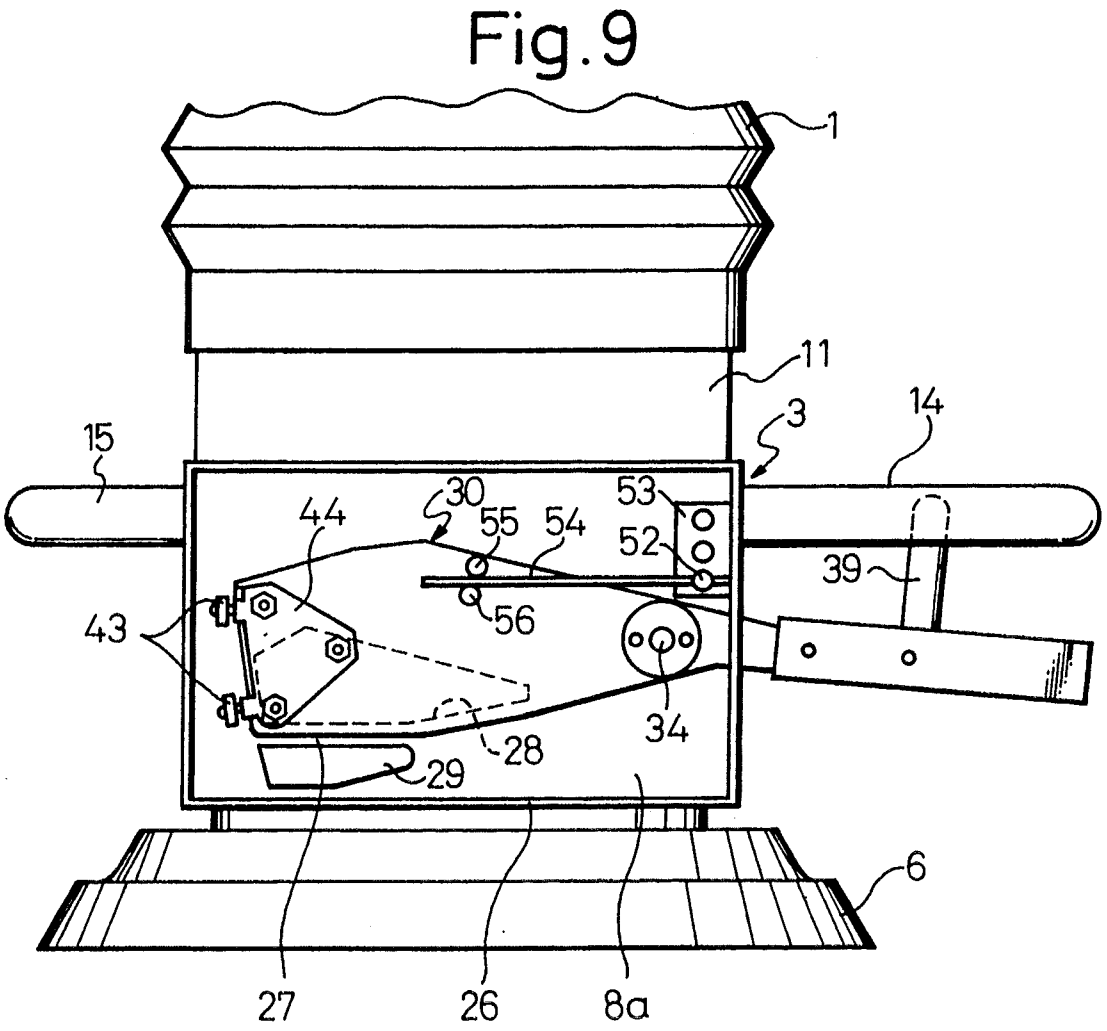
FIG. 9 is a side view of the suction control apparatus of a second embodiment.
Figure 10:
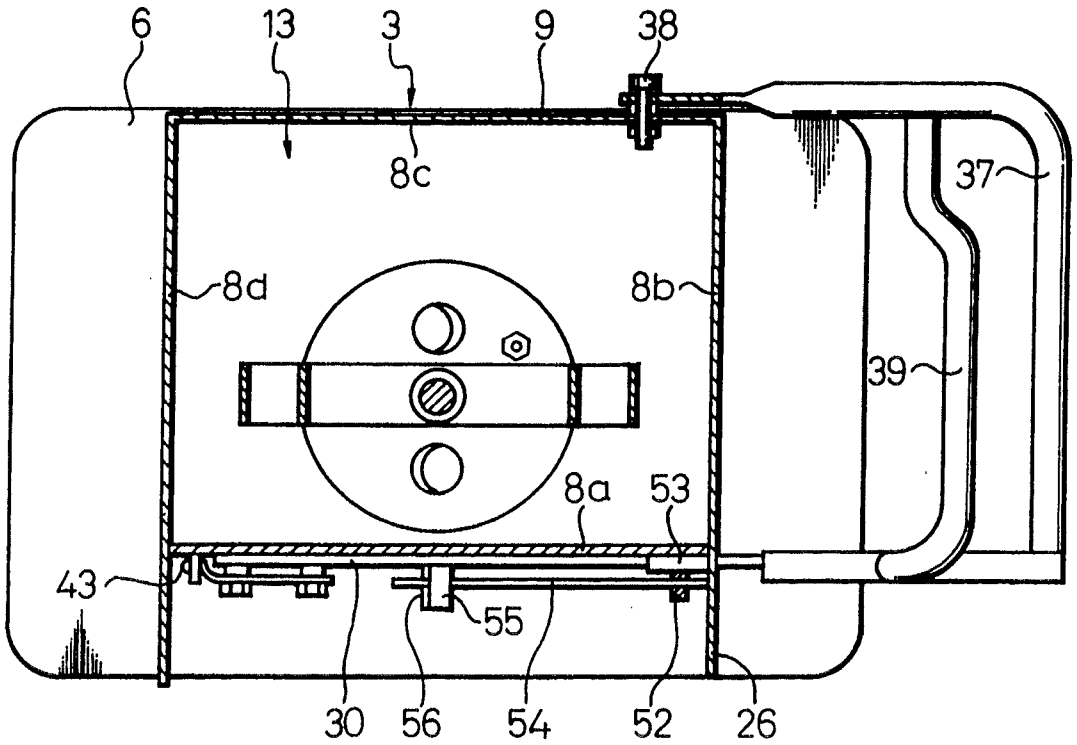
FIG. 10 is a cross-sectional plan view of the suction control apparatus shown in FIG. 9.

FIGS. 9 and 10 illustrate a second embodiment of a vacuum lift device. In this second embodiment, a support plate 53 equipped with a support pin 52 is fixed to the side wall 8*a*, and one of the ends of a straightly extending spring rod 54 is supported by the support pin 52. A pair of spaced support pins 55, 56 are mounted on the lift tube expansion control valve 30, and the tip portion of the spring rod 54 is inserted between the support pins 55, 56. When the operation arms 37, 39 are operated, the lift tube expansion control valve 30 is rotated about the support shaft 34 against the spring force of the spring rod 54. Conversely, when no external force acts on the operation arms 37, 39, as illustrated in FIG. 9, the lower edge of the lift tube expansion control valve 30 is positioned half way on the height of the band-like side wall portion 27.

Figure 11:
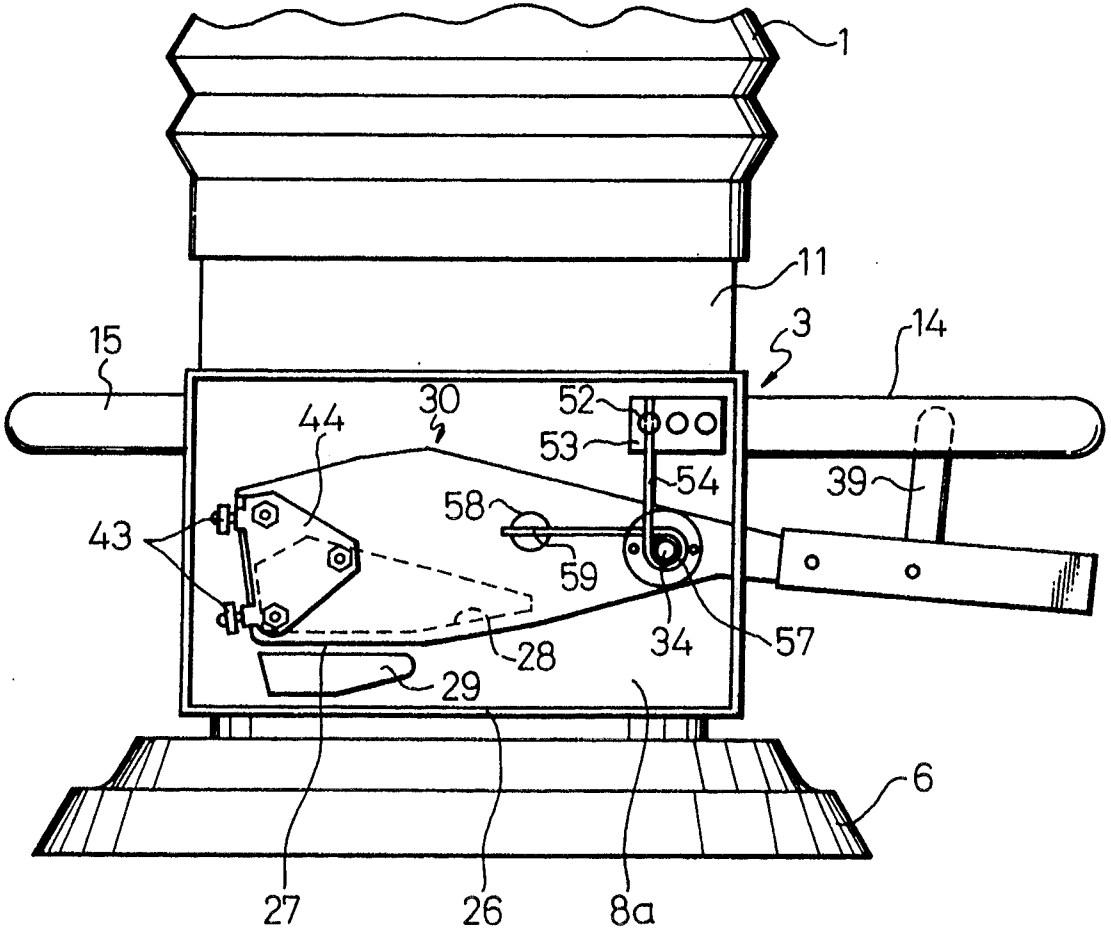
FIG. 11 is a side view of the suction control apparatus of a third embodiment.
Figure 12:
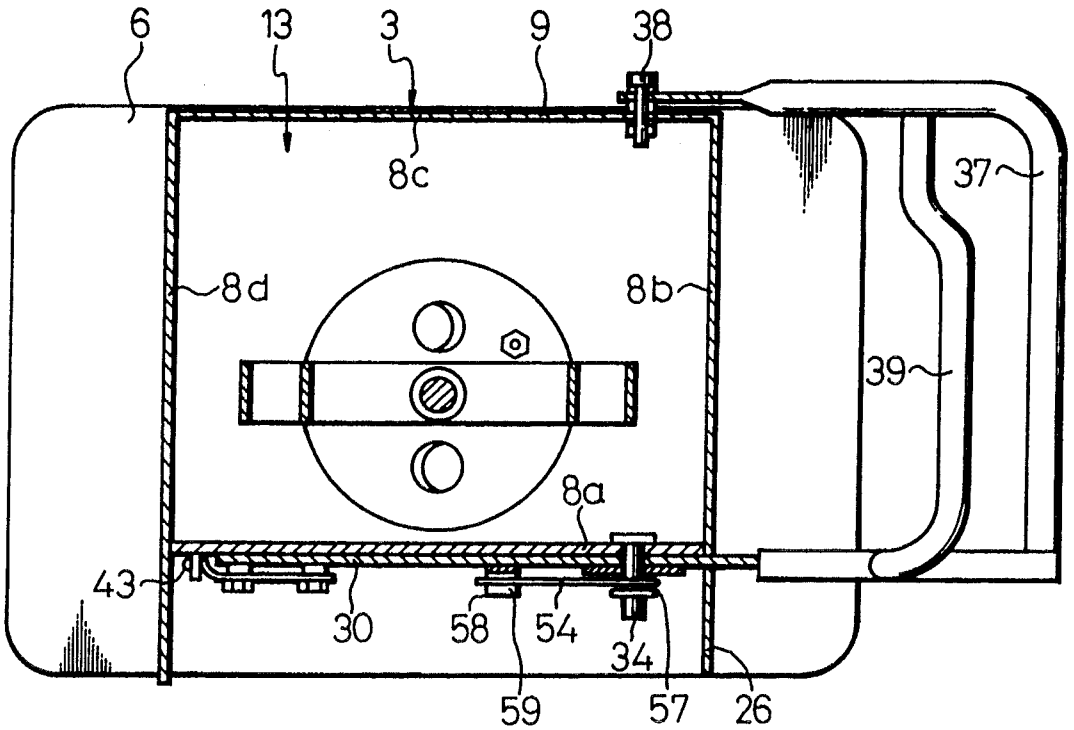
FIG. 12 is a cross-sectional plan view of the suction control apparatus shown in FIG. 11.

FIGS. 11 and 12 illustrate a third embodiment of a vacuum lift device. In this third embodiment, the spring rod 54 has a wound portion 57 in which the spring rod 54 is wound in a coil shape, and this wound portion 57 is inserted around the support shaft 34. One of the ends of the spring rod 54 is fixed to the support pin 52, and the other end of the spring rod 54 is inserted into the slot 59 of the support pin 58 firmly mounted on the lift tube expansion control valve 30. Also in this third embodiment, when the operation arms 37, 39 are operated, the lift tube expansion control valve 30 is rotated about the support shaft 34 against the spring force of the spring rod 54 and, when no external force acts on the operation arms 37, 39, as illustrated in FIG. 11, the lower edge of the lift tube expansion control valve 30 is positioned half way on the height of the band-like side wall portion 27.

Figure 13:
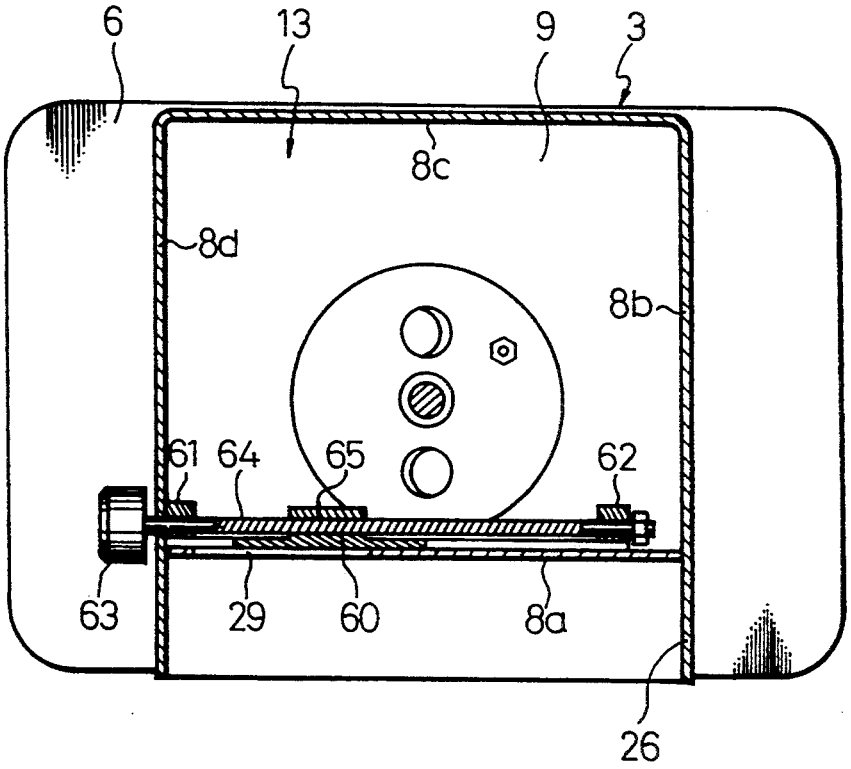
FIG. 13 is a cross-sectional plan view of the suction control apparatus of a fourth embodiment.
Figure 14:
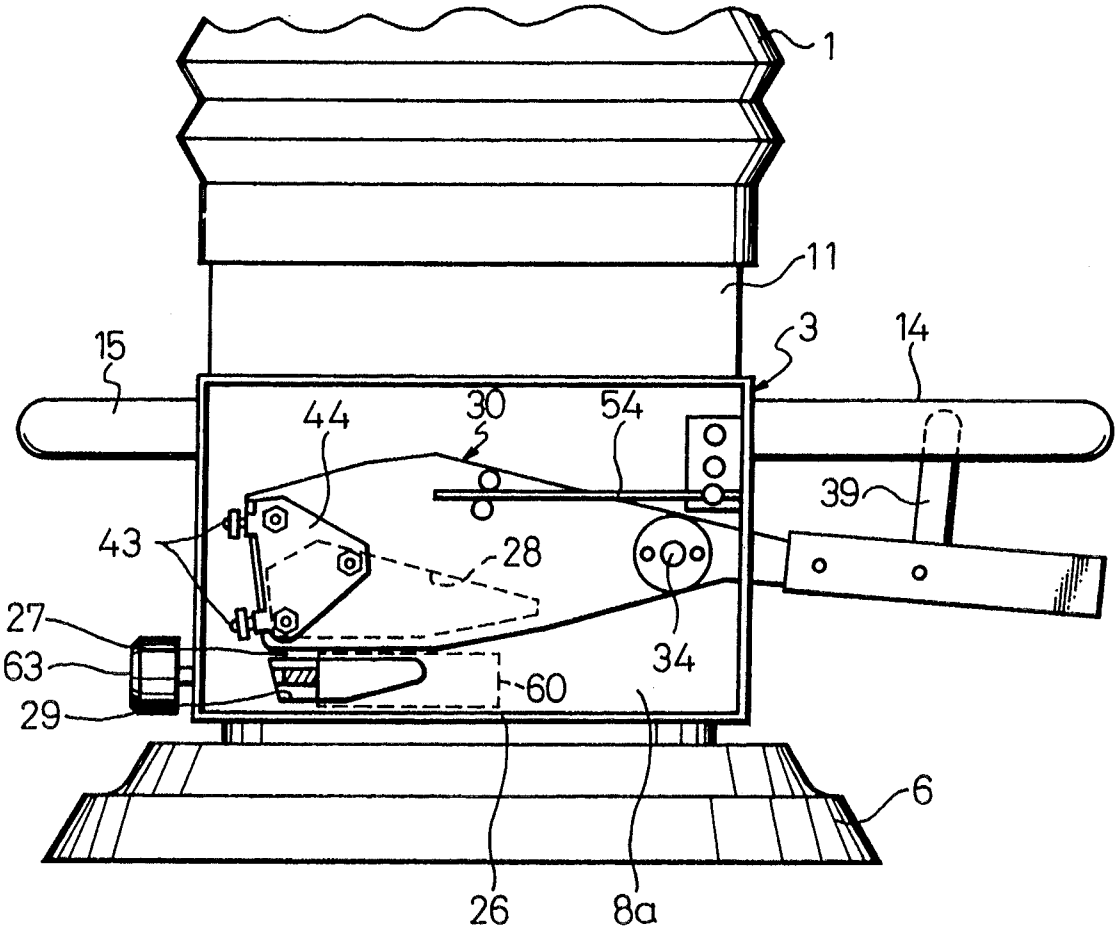
FIG. 14 is a side view of the suction control apparatus shown in FIG. 13.

FIGS. 13 and 14 illustrate a fourth embodiment of a vacuum lift device. In this fourth embodiment, the hovering control valve 60 is slidably arranged on the inner face of the side wall 8*a* so that it is able to partially close the second atmospheric opening 29. A threaded rod 64 having an operation portion 63 and rotatably supported by support members 61, 62 is arranged on the side of the hovering control valve 60, and the threaded portion of the threaded rod 64 is screwed into a threaded bore 65 of the hovering control valve 60. When the operation portion 63 is rotated, the hovering control valve 60 moves in the axial direction of the threaded rod 64, and thereby, the opening area of the second atmospheric opening 29 is controlled.

Figure 15:
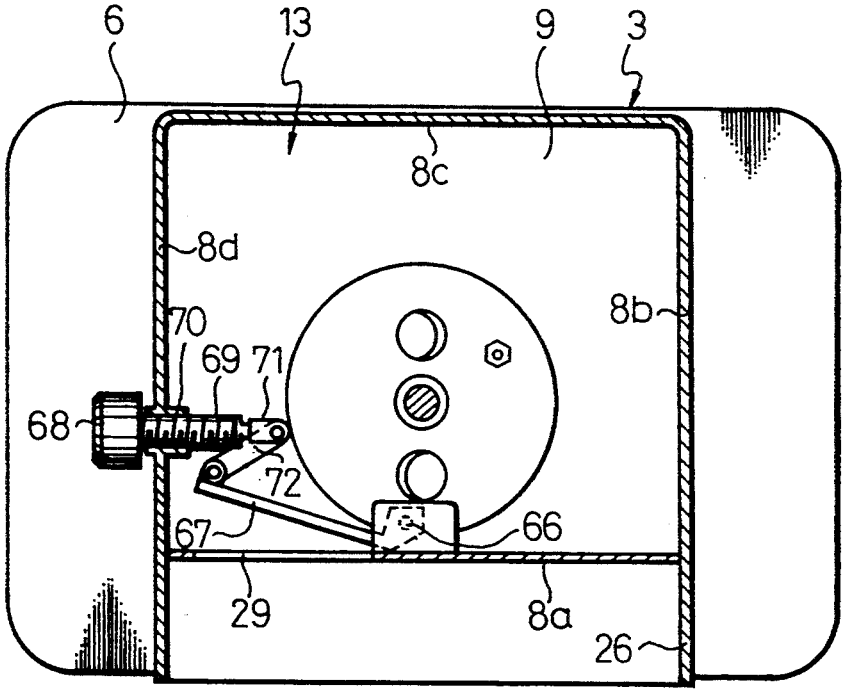
FIG. 15 is a cross-sectional plan view of the suction control apparatus of a fifth embodiment.
Figure 16:
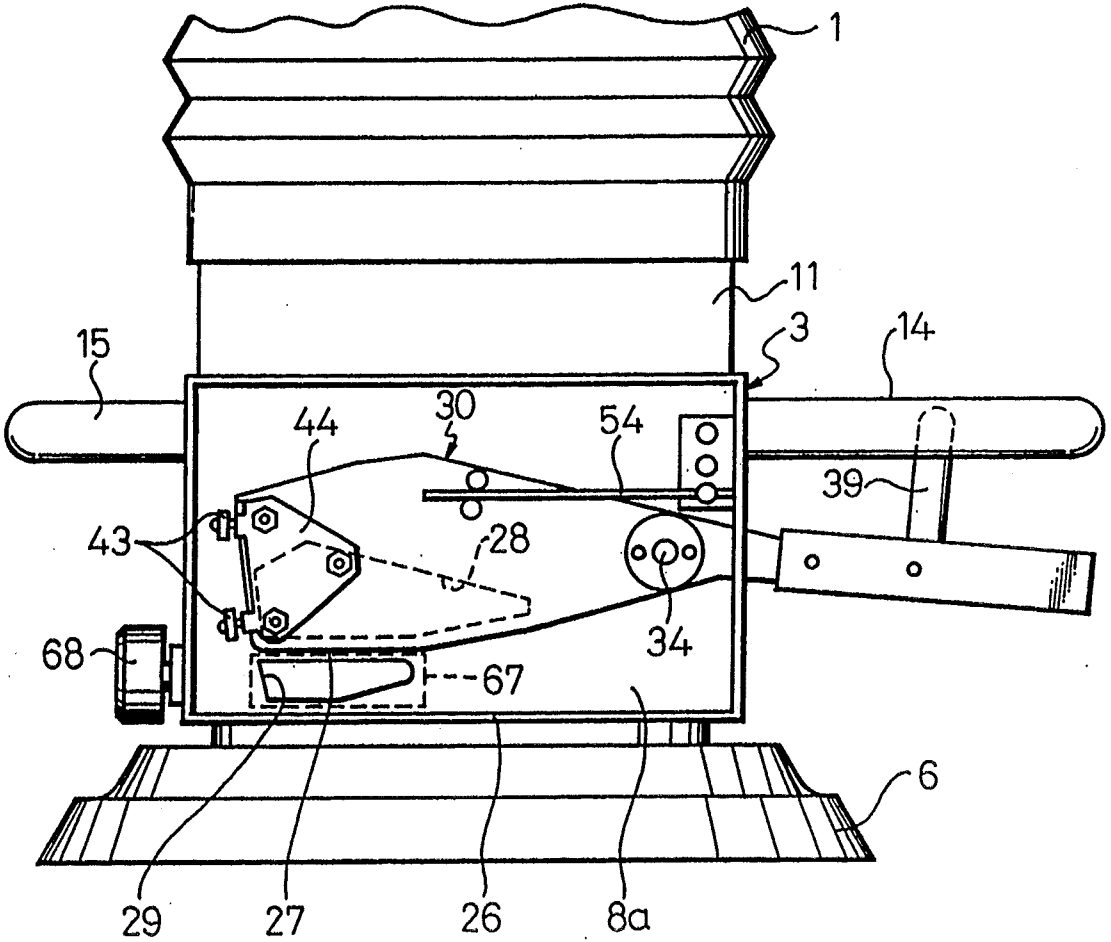
FIG. 16 is a side view of the suction control apparatus shown in FIG. 15.

FIGS. 15 and 16 illustrate a fifth embodiment of a vacuum lift device. In this fifth embodiment, a hovering control valve 67 pivotally supported by a support pin 66 is arranged inside of the second atmospheric opening 29 and, in addition, a threaded rod 69 equipped with an operation portion 68 is screwed into a threaded bore 70. An end member 71 is mounted on the tip portion of the threaded rod 69 so that it can rotate about the axis of the threaded rod 69, and this end member 71 is connected to the tip portion of the hovering control valve 67 via link members 72. When the operation portion 68 is rotated, the hovering control valve 67 is rotated about the support pin 66, and thereby, the flow area of air flowing from the second atmospheric opening 29 is controlled.

Figure 17:
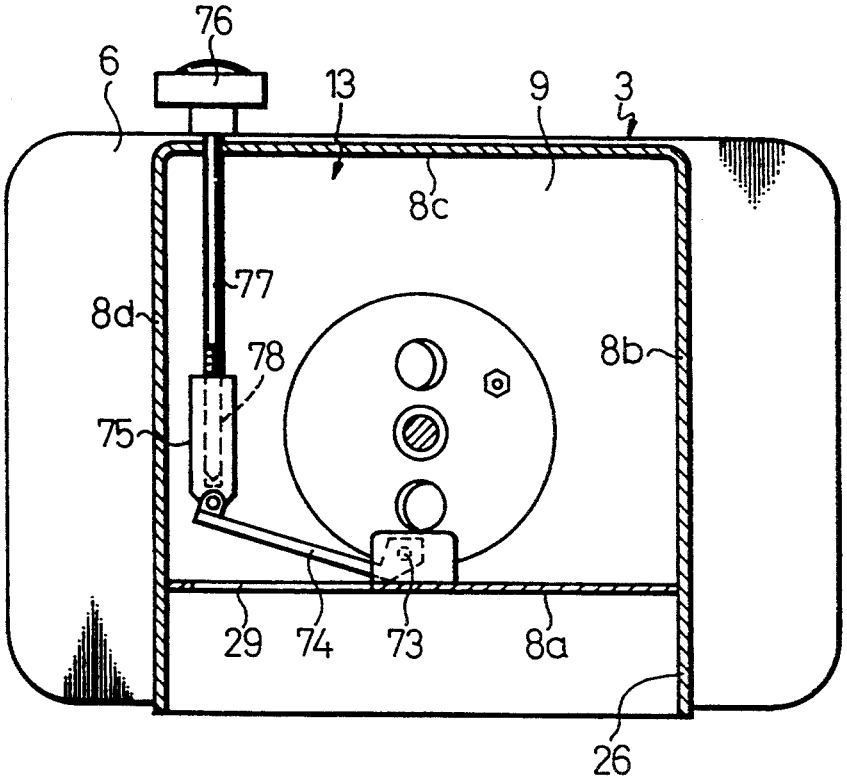
FIG. 17 is a cross-sectional plan view of the suction control apparatus of a sixth embodiment.
Figure 18:
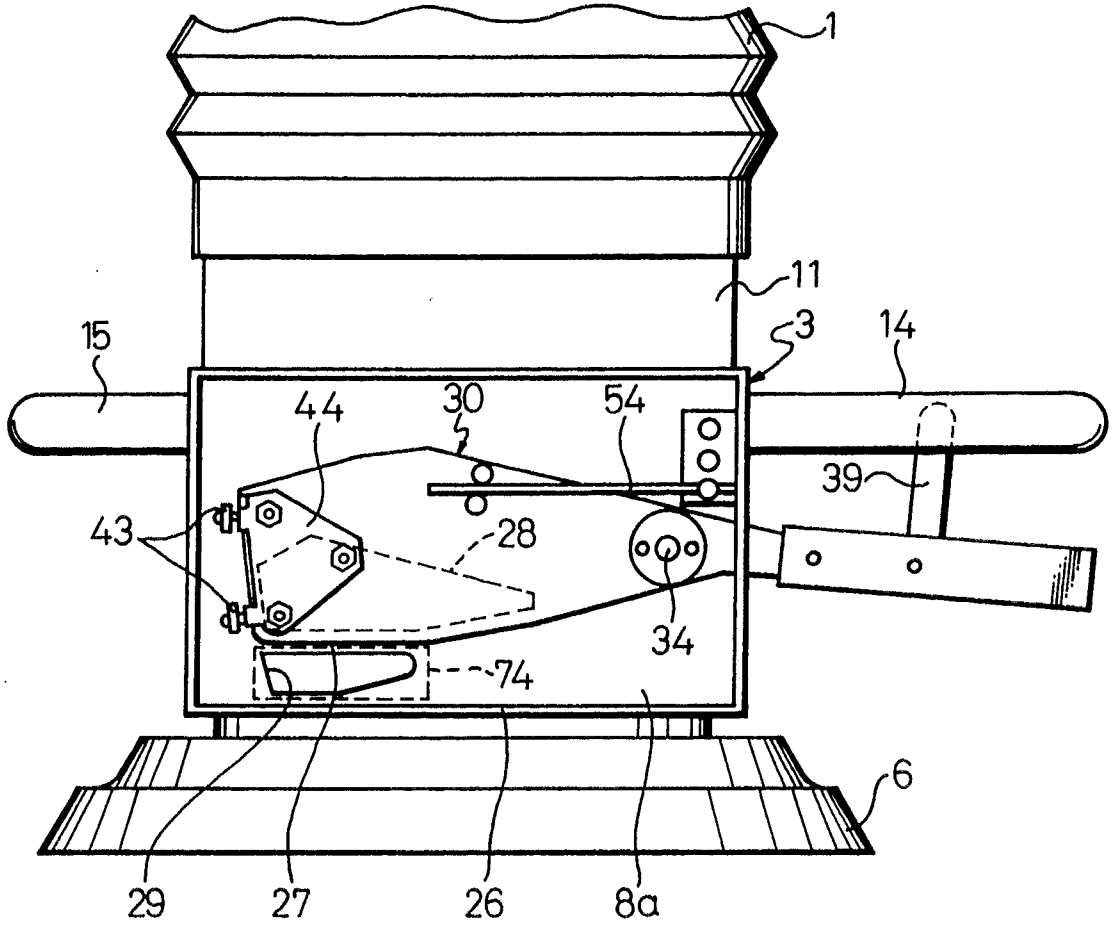
FIG. 18 is a side view of the suction control apparatus shown in FIG. 17.

FIGS. 17 and 18 illustrate a sixth embodiment of a vacuum lift device. In this sixth embodiment, a hovering control valve 74 pivotally supported by a support pin 73 is arranged inside of the second atmospheric opening 29, and a link member 75 is pivotally connected to the tip portion of the hovering control valve 74. The threaded tip portion of a threaded rod 77 equipped with an operation portion 76 is screwed into a threaded bore 78 of the link member 75. When the operation portion 76 is rotated, the hovering control valve 74 is rotated about the support pin 73, and thereby, the flow area of air flowing from the second atmospheric opening 29 is controlled.

According to the present invention, since the opening area of the atmospheric opening can be greatly changed by the lift tube expansion control valve, it is possible to quickly contract and expand the lift tube. In addition, since the level of vacuum in the lift tube can be precisely controlled by the hovering control valve, it is possible to property maintain the object at a desired height.

While the invention has been described by reference to specific embodiments chosen for purposes of illustration, it should be apparent that numerous modifications could be made thereto by those skilled in the art without departing from the basic concept and scope of the invention.

We claim:

1. A vacuum lift device comprising:

a vacuum source;

a vacuum operated type lift tube expandable in a vertical direction and having an interior connected to said vacuum source, said lift tube having an atmospheric opening which interconnects the interior of said lift tube to the outside air, said atmospheric opening comprises a first atmospheric opening and a second atmospheric opening, and opening areas of both said first atmospheric opening and said second atmospheric opening can be controlled by a lift tube control valve;

said lift tube control valve for controlling an opening area of said atmospheric opening to control a level of vacuum in the interior of said lift tube and thereby cause said lift tube to expand and contract in a vertical direction; and hovering control means provided separately from said lift tube control valve, for controlling a flow area of an air between the interior of said lift tube and the outside air to maintain an object lifted by said lift tube at a desired height.

2. A vacuum lift device according to claim 1, wherein the opening areas of both said first atmospheric opening and said second atmospheric opening can be completely closed by said lift tube control valve.

3. A vacuum lift device according to claim 1, further comprising spring means for maintaining said lift tube control valve at a stable position in which said first atmospheric opening is closed by said lift tube control valve and in which said second atmospheric opening is open when said lift tube control valve is in a free state.

4. A vacuum lift device according to claim 3, wherein said lift tube has a flat side wall on which said first atmospheric opening and said second atmospheric opening are formed, and said first atmospheric opening is spaced from said second atmospheric opening via a band-like side wall portion, said lift tube control valve being pivotally supported by a pivot on said lift tube and having a valve plate which is slidable on said flat side wall, a lower edge of said valve plate being positioned in said band-like side wall portion when said lift tube control valve is in the free state.

5. A vacuum lift device according to claim 4, wherein said lift tube control valve has a spring retainer on said atmospheric openings side with respect to said pivot, and said spring means comprises a tension spring extending from said spring retainer in a direction opposite to said pivot, one end of said tension spring being supported by said spring retainer, the other end of said tension spring being supported by said lift tube.

6. A vacuum lift device according to claim 4, wherein said lift tube control valve has a spring retainer on said atmospheric openings side with respect to said pivot, and said spring means comprises a spring rod extending from said spring retainer toward said pivot side, one end of said spring rod being supported by said spring retainer, the other end of said spring rod being fixed to said lift tube.

7. A vacuum lift device according to claim 6, wherein said spring retainer comprises a pair of spaced support pins, and said one end of said spring rod is inserted between said support pins.

8. A vacuum lift device according to claim 6, wherein said spring retainer comprises a support pin having a slot formed thereon, and said one end of said spring rod is inserted into said slot.

9. A vacuum lift device according to claim 6, wherein said spring rod has a wound portion at an intermediate portion thereof, and said wound portion is fitted around said pivot.

10. A vacuum lift device according to claim 4, wherein said lift tube control valve has a roller rolling on said side wall and rotatably supported by an end portion of said lift tube control valve, which is located furthest from said pivot, to slightly float said lift tube control valve from said side wall.

11. A vacuum lift device according to claim 1, wherein said hovering control means controls a flow area of an air flowing within said second atmospheric opening.

12. A vacuum lift device according to claim 11, wherein said hovering control means comprises an air flow passage formed between the interior of said lift tube and said second atmospheric opening, and a rotary valve having a threaded portion which projects into and retracts from said air flow passage.

13. A vacuum lift device according to claim 11, wherein said hovering control means directly cooperates with said second atmospheric opening to control the flow area of an air flowing within said second atmospheric opening.

14. A vacuum lift device according to claim 13, wherein said hovering control means comprises a slide valve which is able to control an opening area of said second atmospheric opening.

15. A vacuum lift device according to claim 14, wherein said hovering control means comprises a manually operated rotary operation portion arranged outside of said lift tube, and a mechanism for changing the rotation of said operation portion to the sliding movement of said slide valve.

16. A vacuum lift device according to claim 13, wherein said hovering control means comprises a valve plate pivotally supported by said lift tube and arranged to cover said second atmospheric opening.

17. A vacuum lift device according to claim 16, wherein said hovering control means comprises a manually operated rotary operation portion arranged outside of said lift tube, and a mechanism for changing the rotation of said operation portion to the pivotal movement of said valve plate.

* * * * *